US007229160B2

(12) United States Patent
Kobayashi

(10) Patent No.: US 7,229,160 B2
(45) Date of Patent: Jun. 12, 2007

(54) LIQUID DELIVERING APPARATUS AND METHOD OF PRODUCING THE SAME

(75) Inventor: Kazuo Kobayashi, Kahamigahara (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 175 days.

(21) Appl. No.: 10/876,529

(22) Filed: Jun. 28, 2004

(65) Prior Publication Data

US 2005/0012786 A1 Jan. 20, 2005

(30) Foreign Application Priority Data

Jul. 15, 2003 (JP) ..... 2003-197256

(51) Int. Cl.
*B41J 2/045* (2006.01)
*H04R 17/00* (2006.01)

(52) U.S. Cl. ..... 347/68; 29/25.35

(58) Field of Classification Search ..... 347/68, 347/70–72; 29/25.35
See application file for complete search history.

(56) References Cited

U.S. PATENT DOCUMENTS

| | | | | |
|---|---|---|---|---|
| 5,376,856 | A * | 12/1994 | Takeuchi et al. | 310/328 |
| 5,475,279 | A | 12/1995 | Takeuchi et al. | |
| 5,818,482 | A * | 10/1998 | Ohta et al. | 347/70 |
| 6,070,972 | A | 6/2000 | Thiel | |
| 6,142,615 | A * | 11/2000 | Qiu et al. | 347/70 |
| 6,375,310 | B1 | 4/2002 | Arakawa et al. | |
| 6,494,566 | B1 | 12/2002 | Kishino et al. | |
| 6,911,107 | B2 | 6/2005 | Kagawa et al. | |
| 2003/0103116 | A1 | 6/2003 | Sugahara et al. | |

FOREIGN PATENT DOCUMENTS

| | | |
|---|---|---|
| EP | 0 426 473 A2 | 5/1991 |
| EP | 0 736 385 A1 | 10/1996 |
| EP | 0 786 345 A2 | 7/1997 |
| JP | A-6-40035 | 2/1994 |
| JP | A-10-180939 | 7/1998 |
| JP | A-10-211705 | 8/1998 |
| JP | A-10-305574 | 11/1998 |
| JP | 11-034341 | 2/1999 |
| JP | 11-334066 | 12/1999 |
| JP | A-11-334087 | 12/1999 |
| JP | A-2000-343711 | 12/2000 |
| JP | A-2002-134806 | 5/2002 |
| JP | A-2003-142750 | 5/2003 |

* cited by examiner

*Primary Examiner*—An H. Do
(74) *Attorney, Agent, or Firm*—Oliff & Berridge, PLC

(57) ABSTRACT

A method of producing at least one liquid delivering apparatus which delivers a liquid from at least one liquid chamber thereof to a location outside the at least one liquid delivering apparatus, by deforming a piezoelectric element thereof provided at a location opposed to the at least one liquid chamber and thereby applying a pressure to the liquid in the at least one liquid chamber. The method includes the steps of stacking a first sheet member having at least one opening defining the at least one liquid chamber and a second sheet member covering the at least one opening, on each other, so as to provide an integral, stacked body; forming, of a material of the piezoelectric element, a layer on at least a portion of the second sheet member of the stacked body that is opposed to the at least one opening of the first sheet member of the stacked body; and annealing the layer formed on the stacked body, and thereby crystallizing the material of the layer, so as to change the layer into the piezoelectric element.

24 Claims, 7 Drawing Sheets

LIQUID DELIVERING APPARATUS AND METHOD OF PRODUCING THE SAME

The present application is based on Japanese Patent Application No. 2003-197256 filed Jul. 15, 2003, the contents of which are incorporated herein by reference.

BACKGROUND OF THE INVENTION

1. Field of the Invention

The present invention relates to a liquid delivering apparatus, in particular, such a liquid delivering apparatus in which a piezoelectric element can be driven at a low drive voltage so as to apply a high pressure to a liquid accommodated by a liquid chamber and thereby deliver the liquid from the chamber to a location outside the chamber. The present invention also relates to a method of producing the liquid delivering apparatus.

2. Related Art Statement

There have conventionally been known various sorts of liquid delivering apparatuses each of which delivers a liquid by using a piezoelectric element, for example, a piezoelectric-type ink jet recording head which is employed by an ink jet recording apparatus. An example of a method of producing the conventional piezoelectric-type ink jet recording head is disclosed by Japanese Patent Publication No. 11-34341. The piezoelectric-type ink jet recording head produced by the disclosed method includes a first piezoelectric layer as an elastic sheet; a common electrode printed on an entire surface of the first piezoelectric layer; and a second piezoelectric layer stacked on the common electrode. The two piezoelectric layers and the common electrode sandwiched by the two layers are subjected to vacuum pressing and then firing, so as to provide an integral body. After the second piezoelectric layer is polarized, the integral body and a cavity sheet having a plurality of ink chambers are stacked on each other, such that the first piezoelectric layer as the elastic sheet is adhered to the cavity sheet with an adhesive. Finally, a plurality of individual electrodes each having a strip-like shape are formed, on the second piezoelectric layer, at respective locations aligned with the ink chambers of the cavity sheet. Thus, a piezoelectric actuator is completed. Moreover, a nozzle sheet and a drive circuit are connected to the thus assembled piezoelectric actuator, and the piezoelectric-type ink jet recording head is completed.

When a positive voltage is applied to an arbitrary one of the individual electrodes and a negative voltage is applied to the common electrode, a strip-like portion of the piezoelectric actuator that is aligned with the one individual electrode is deformed, and is curved into a corresponding one of the ink chambers of the cavity sheet. More specifically explained, the strip-like portion of the piezoelectric actuator is shrunk in directions parallel to the major surfaces of the piezoelectric layers but, since the elastic sheet restrains the shrinkage of the strip-like portion, the strip-like portion is curved toward the ink chamber of the cavity sheet. Consequently the ink accommodated by the ink chamber is compressed, and a droplet of the ink is ejected from an ink ejection nozzle communicating with the ink chamber, so that an image is recorded on a recording medium such as a sheet of paper.

SUMMARY OF THE INVENTION

However, the above-indicated method is for producing such an ink jet recording head which employs a piezoelectric element having a considerably great thickness, because the piezoelectric element is formed by firing stacked piezoelectric layers.

Meanwhile, when the ink is ejected from the ink chamber, it is needed to apply a greater stress to an elastic sheet having a greater thickness, i.e., a greater rigidity. In order to apply the great stress to the elastic sheet, it is needed to deform largely the piezoelectric element and accordingly it is needed to apply a high drive voltage to the piezoelectric element.

Since a thinner elastic sheet has a smaller rigidity, the thinner elastic sheet can be operated at a lower drive voltage. However, in the above-indicated ink jet recording head producing method, it is difficult to prepare a thin piezoelectric layer whose thickness ranges from about several microns (μm) to about 10 μm, in view of the limits of formation of thin layer and/or the limits of handling of the same. From this point, too, it is needed to apply a high drive voltage to the piezoelectric element.

As a common method of forming a thin piezoelectric layer, there is known an aerosol deposition method in which super-fine particles as a material of the piezoelectric layer are sprayed to, and deposited on, a sheet member as a substrate. However, in the case where this method is used to form a piezoelectric layer on a thin elastic sheet, the thin elastic sheet may be seriously damaged by the stresses produced therein by the energy of the fine particles sprayed thereto at high speeds.

As another method of producing a thin piezoelectric layer, there is known a sol-gel method in which a solution of a material of the piezoelectric layer is applied by spin coating, the applied solution is heated, and the application of the solution and the heating of the applied solution are repeated. However, in the case where this method is used to form a piezoelectric layer on a thin elastic sheet, the elastic sheet may be easily curled because of the repeatedly applied thermal stresses.

It is therefore an object of the present invention to provide a method of producing a liquid delivering apparatus that is free of at least one of the above-indicated problems. It is another object of the present invention to provide a liquid delivering apparatus in which a piezoelectric element can be driven at a low drive voltage so as to apply a high pressure to a liquid accommodated by a liquid chamber and thereby deliver the liquid from the chamber to a location outside the chamber.

According to a first aspect of the present invention, there is provided a method of producing at least one liquid delivering apparatus which delivers a liquid from at least one liquid chamber thereof to a location outside the at least one liquid delivering apparatus, by deforming a piezoelectric element thereof provided at a location opposed to the at least one liquid chamber and thereby applying a pressure to the liquid in the at least one liquid chamber. The method comprises the steps of stacking a first sheet member having at least one opening defining the at least one liquid chamber and a second sheet member covering the at least one opening, on each other, so as to provide an integral, stacked body; forming, of a material of the piezoelectric element, a layer on at least a portion of the second sheet member of the stacked body that is opposed to the at least one opening of the first sheet member of the stacked body; and annealing the layer formed on the stacked body, and thereby crystallizing the material of the layer, so as to change the layer into the piezoelectric element.

In the method according to the first aspect of the present invention, the piezoelectric layer is formed on the second sheet member which is integrated with the first sheet member and accordingly has a higher rigidity than a rigidity thereof in a state in which the second sheet member is separate from the first sheet member. Therefore, the second sheet member can enjoy improved impact resistance and accordingly can be effectively prevented from being damaged by the formation of the piezoelectric layer.

In addition, since the piezoelectric layer is crystallized in the annealing step, without the stacked sheet members being damaged, the piezoelectric element can exhibit its proper characteristics or even improve the same.

In the present method, a piezoelectric element which is driven at a low voltage to produce a large amount of deformation, can be formed. Therefore, the present method can produce a liquid delivering apparatus which can be operated at reduced electric power consumption.

According to a second aspect of the present invention, there is provided a liquid delivering apparatus comprising a first sheet member which has at least one liquid chamber accommodating a liquid; a second sheet member which is stacked on the first sheet member to cover the at least one liquid chamber thereof; and a piezoelectric element which is provided on at least a portion of the second sheet member that is opposed to the at least one liquid chamber of the first sheet member, and which is deformed to apply a pressure to the liquid in the at least one liquid chamber and thereby deliver the liquid from the at least one liquid chamber to a location outside the liquid delivering apparatus. The first and second sheet members are integrated with each other by diffusion bonding or anode bonding.

In the apparatus according to the second aspect of the present invention, the first and second sheet members are integrated with each other by diffusion bonding or anode bonding. Thus, even though the stacked sheet members may be annealed at such a temperature at which organic matters would be decomposed, the bonded surfaces of the stacked sheet members can maintain a high bonding strength, and the stacked sheet members cannot be easily separated from each other.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
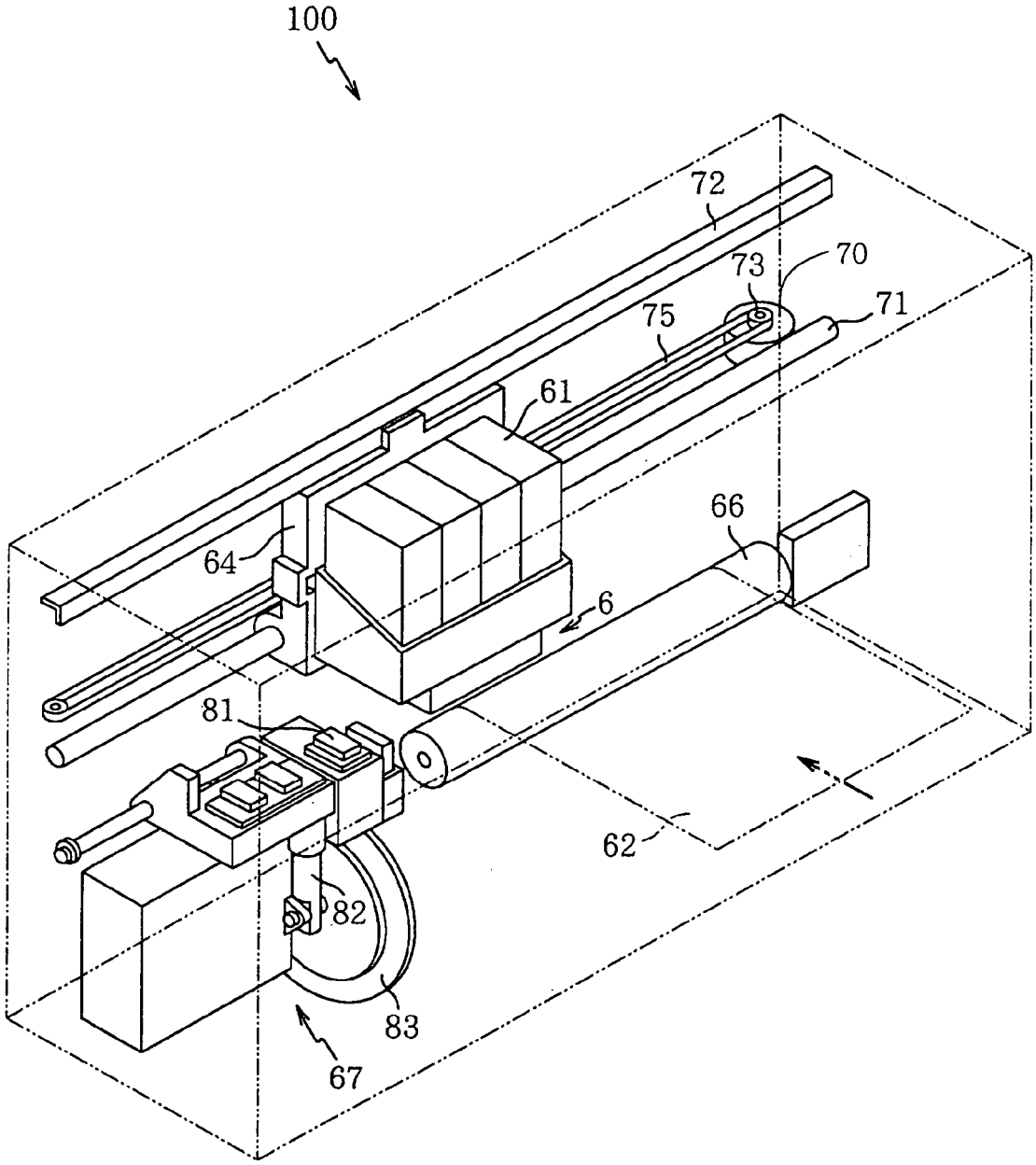
FIG. 1 is a perspective view of an ink jet recording apparatus employing a piezoelectric ink jet recording head which is produced by a method according to the present invention.

Hereinafter, there will be described a preferred embodiment of the present invention by reference to the drawings. FIG. 1 shows an ink jet recording apparatus 100 employing a piezoelectric ink jet recording head 6 which is produced by a method according to the present invention. First, the ink jet recording apparatus 100 is briefly described. The piezoelectric ink jet recording head 6 is for recording an image on a sheet of paper 62 as a sort of recording medium, and is mounted, together with ink cartridges 61, on a carriage 64.

The carriage 64 is secured to an endless belt 75 and, when a pulley 73 is rotated forward or backward by an electric motor 70, the endless belt 75 is moved and accordingly the carriage 64 is linearly reciprocated along a shaft member 71 and a guide plate 72. While the carriage 64 is moved, ink ejection nozzles 54 (FIG. 3) of the recording head 6 eject respective droplets of ink toward the paper 62. The paper 62 is fed from a paper feed cassette, not shown, to a gap provided between the recording head 6 and a platen roller 66 and, after the recording head 6 records the image on the paper 62, the paper 62 is discharged into a paper collect cassette, not shown. Paper feeding and discharging devices are not shown in FIG. 1.

A purging device 67 is provided on a side of the platen roller 66. The purging device 67 is for removing bad ink occluding the nozzles 54 of the recording head 6. When the carriage 64 is positioned at a resetting position, a purging cap 81 covers a nozzle supporting surface of the recording head 6 so as to form a gas-tight space whose pressure is lowered by an electric pump 82 which communicates with the purging cap 81 and is operated by a cam 83. Thus, the bad ink that may occlude the nozzles 54 of the recording head 6 is removed by the purging device 67.

Figure 2:
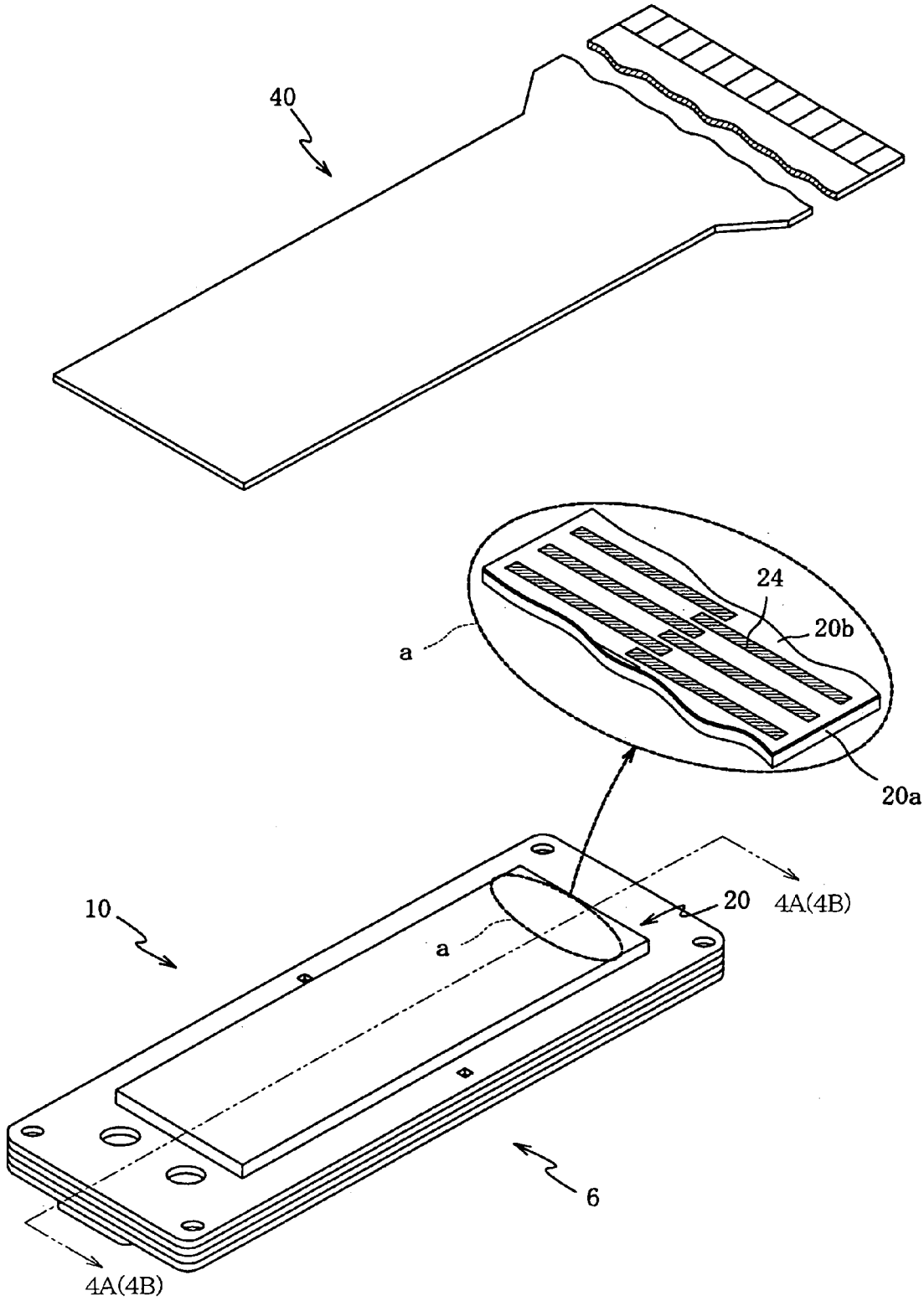
FIG. 2 is an exploded, perspective view of the piezoelectric recording head.

Next, there will be described a construction of the piezoelectric ink jet recording head 6, by reference to FIGS. 2 and 3. As shown in FIG. 2, the recording head 6 includes an ink accommodating portion 10 and a pressure applying portion 20.

The ink accommodating portion 10, except for a nozzle sheet 43 that will be described later, is provided by an integral body which is obtained by stacking a plurality of sheet members, each formed of an inorganic material, on each other. The sheet members are, for example, metallic sheet members, and the metallic sheet members are, for example, rolled metallic sheets each formed of, e.g., stainless steel, titanium, titanium alloy, copper, copper alloy, tool steel, low alloy steel, nickel, nickel alloy, cobalt alloy, aluminum, or aluminum alloy.

However, the sheet members are not limited to the metallic ones. For example, the sheet members may be provided by green sheets which are obtained by dispersing a glass powder, such as borosilicate glass, lead glass, soda glass, or soda lime glass, in a binder such as acrylic resin, and forming the thus obtained dispersion into the sheets. In the present embodiment, in the case where the sheet members are provided by the metallic sheet members, stainless sheet members are used as the metallic sheet members; and in the case where the sheet members are provided by the green sheets, borosilicate glass green sheets are used as the green sheets. A glass composition used to form the green sheets is so prepared as not to soften under heating conditions which are employed when a piezoelectric layer 20*b*, described later, is formed (see, a PZT layer forming step (S3, FIG. 5) and an annealing step (S4)).

In the present embodiment, a portion (i.e., the nozzle sheet 43) of the ink accommodating portion 10 is formed of a synthetic resin, and accordingly that portion is assembled with the other metallic or glass portions of the same 10 after those steps, such as the annealing step (S4), which need heating that would otherwise deform the synthetic resin.

In the case where the ink accommodating portion 10 employs the metallic sheet members, the metallic sheet members are integrated with each other, such that respective interfaces of the stacked, metallic sheet members are bonded to each other by solid-phase diffusion. In the case where the ink accommodating portion 10 employs the glass sheet members, the glass sheet members are integrated with each other, such that respective interfaces of the stacked green sheets are bonded to each other by firing. Thus, in the present embodiment, there is no organic adhesive on the respective interfaces of the stacked sheet members of the ink accommodating portion 10. Next, a construction of the ink accommodating portion 10 will be described in detail, below, by reference to FIG. 3.

Figure 3:
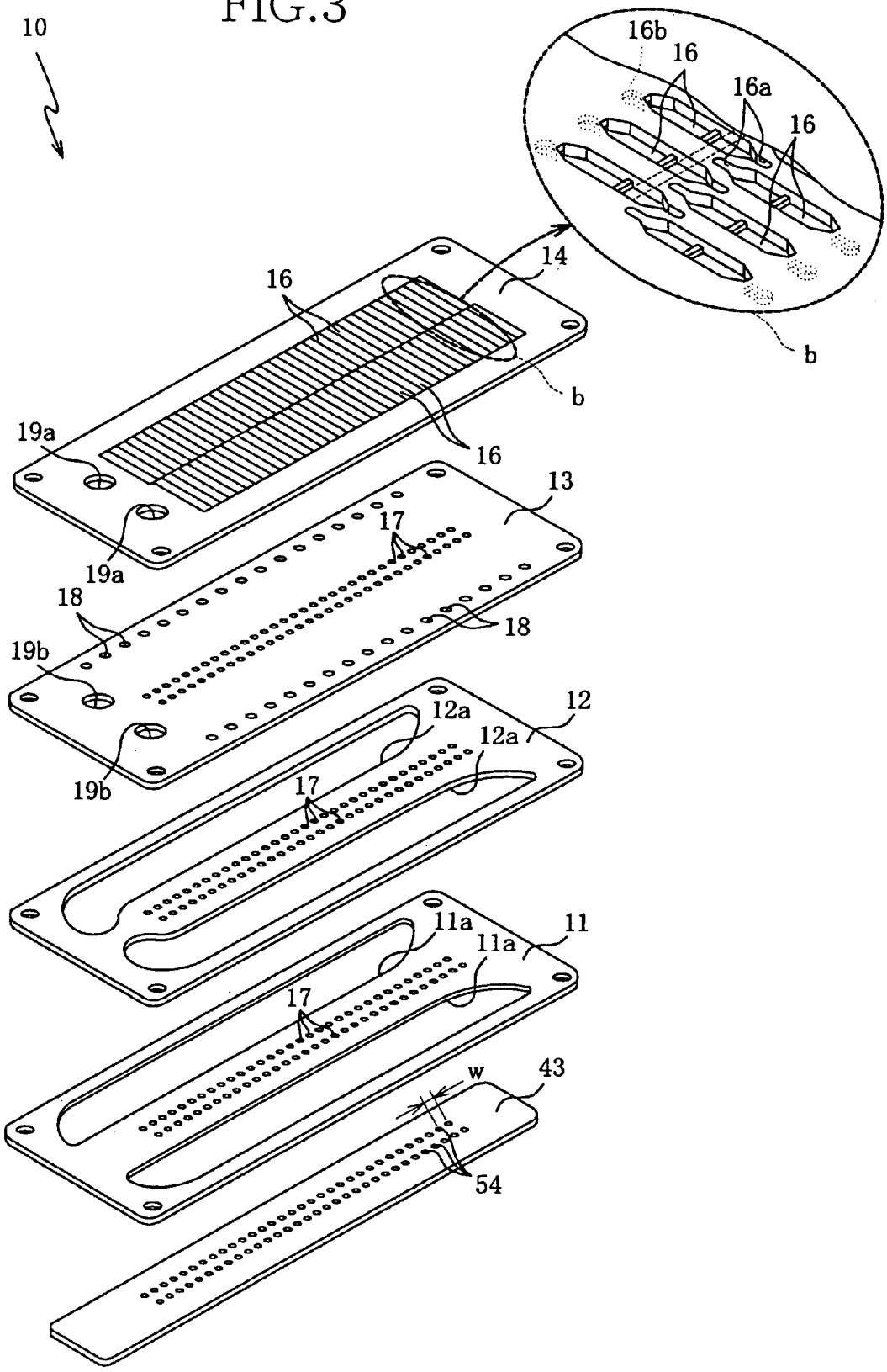
FIG. 3 is an exploded, perspective view of an ink accommodating portion of the recording head.

As shown in FIG. 3, the ink accommodating portion 10 includes four sheet members, i.e., two manifold sheets 11, 12, a spacer sheet 13, and a cavity sheet 14 which are stacked on, and integrated with, each other as described above, and additionally includes the nozzle sheet 43 which is adhered to the integral, stacked sheets 11, 12, 13, 14. In the present embodiment, each of the sheet members 11, 12, 13, 14, 43 has a thickness ranging from about 50 μm to about 150 μm.

The nozzle sheet 43 is formed of a synthetic resin, and provides a lowermost layer of the ink accommodating portion 10. The nozzle sheet 43 has a plurality of ink ejection nozzles 54 each of which has a small diameter and which are arranged in two arrays in a zigzag pattern in a lengthwise direction (hereinafter referred to as the first direction, when appropriate) of the ink accommodating portion 10. In each array of nozzles 54, the nozzles 54 are arranged at a regular, small interval of distance, w, as shown in FIG. 3.

The first manifold sheet 11 is a sheet member located on an upper surface of the nozzle sheet 43. The first manifold sheet 11 has, in an upper surface thereof, two manifold openings 11*a*, 11*a* which open upward and extend along the two arrays of ink ejection nozzles 54, respectively.

The second manifold sheet 12 is stacked on an upper surface of the first manifold sheet 11. The second manifold sheet 12 has two manifold openings 12*a*, 12*a* which are formed through a thickness of the sheet 12. The two manifold openings 12*a* of the second manifold sheet 12 are aligned with the corresponding manifold openings 11*a* of the first manifold sheet 11, and have the substantially same shapes in their plan view, as those of the manifold openings 11*a*. Thus, the two manifold openings 12*a* cooperate with the two manifold openings 11*a* to define two manifold chambers 11*a*, 12*a*; 11*a*, 12*a* each as part of an ink channel. The two manifold chambers 11*a*, 12*a* are aligned, in their plan view, with two arrays of liquid chambers 16, described later, respectively, and extend along those arrays, respectively.

The cavity sheet 14 is stacked on the second manifold sheet 12 via a spacer sheet 13, and provides an uppermost layer of the ink accommodating portion 10. The cavity sheet 14 has a plurality of liquid chambers 16 which are arranged, along a centerline thereof, in two arrays in a zigzag fashion in the lengthwise direction (i.e., the first direction) of the ink accommodating portion 10. In a state in which the four sheet members 11, 12, 13, 14 are stacked on each other, the liquid chambers 16 open upward in an upper surface of the cavity sheet 14 that is opposite to the spacer sheet 13.

The two arrays of liquid chambers 16 are provided on either side of the above-indicated centerline of the cavity sheet 14, respectively. The liquid chambers 16 of one array are alternate with the liquid chambers 16 of the other array in the lengthwise direction of the ink accommodating portion 10, and each of the liquid chambers 16 has an elongate shape extending in a widthwise direction (hereinafter, referred to as the second direction, when appropriate) of the portion 10 that is perpendicular to the lengthwise direction (i.e., the first direction) of the portion 10 and the centerline of the cavity sheet 14.

An inner end portion 16*a* of each of the liquid chambers 16 communicates with a corresponding one of the ink ejection nozzles 54 of the nozzle sheet 43 via corresponding small-diameter through-holes 17 which are formed through respective thickness of the spacer sheet 13 and the two manifold sheets 11, 12. An outer end portion 16*b* of the each liquid chamber 16 communicates with a corresponding one of the two manifold chambers 11*a*, 12*a*; 11*a*, 12*a* via a small-diameter through-hole 18 which is formed through a thickness of the spacer sheet 13. As shown in an enlarged view indicated at "b" in FIG. 3, the outer end portion 16*b* of each liquid chamber 16 opens in only a lower surface of the cavity sheet 14. The cavity sheet 14 has, in one of lengthwise end portions thereof, two first supply holes 19*a*, 19*a*, and the spacer sheet 13 has, in a corresponding one of lengthwise end portions thereof, two second supply holes 19*b*, 19*b* which are aligned with the two first supply holes 19*a*, 19*a*, respectively. The two first supply holes 19*a* and the two second supply holes 19*b* communicate with the two manifold chambers 11*a*, 12*a*; 11*a*, 12*a*, respectively.

Figure 4A:
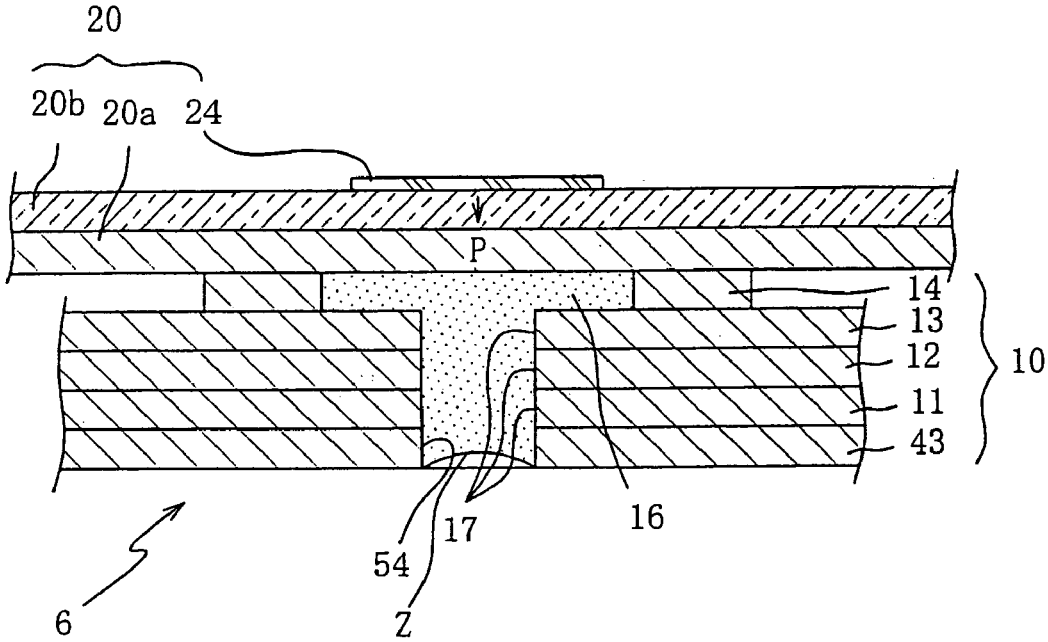
FIG. 4A is a cross-sectional view of the recording head, taken along 4A—4A in FIG. 2, in a state in which a drive voltage is not applied to the recording head.
Figure 4B:
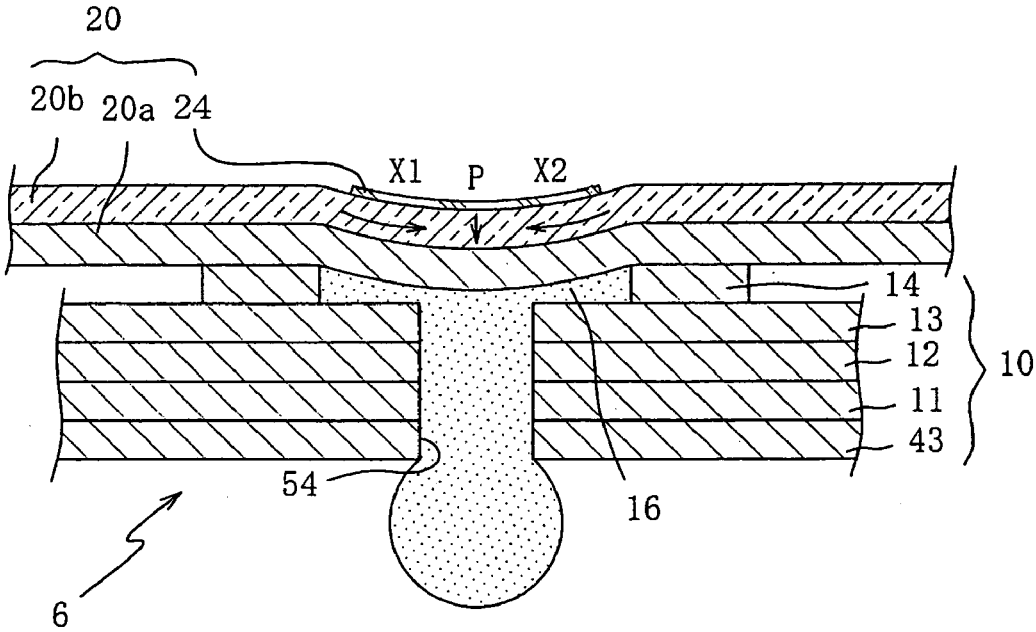
FIG. 4B is a cross-sectional view of the recording head, taken along 4B—4B in FIG. 2, in a state in which the drive voltage is applied to the recording head.

Thus, an ink supplied from one of the ink cartridges 61 flows into each of the two manifold chambers 11*a*, 12*a*; 11*a*, 12*a* via the first and second supply holes 19*a*, 19*b*, and then the ink is delivered from the each manifold chamber 11*a*, 12*a* to each of the liquid chambers 16 via a corresponding one of the through-holes 18. Finally, the ink is delivered from each of the liquid chambers 16 to a corresponding one of the ink ejection nozzles 54 via the corresponding through-holes 17 of the spacer sheet 13 and the two manifold sheets 11, 12, as shown in FIGS. 4A and 4B.

The pressure applying portion 20 is for changing a volume of each of the liquid chambers 16 of the ink accommodating portion 10, and is provided by a piezoelectric actuator which is operated upon application thereto of an electric voltage. The pressure applying portion 20 is stacked on an upper surface of the ink accommodating portion 10, i.e., the upper surface of the cavity sheet 14 as the uppermost layer of the ink accommodating portion 10, and has a rectangular shape which assures that the pressure applying portion 20 can cover respective upper openings of all the liquid chambers 16. The pressure applying portion 20 includes a diaphragm 20*a* formed of a rolled metallic sheet, a piezoelectric layer 20*b* formed on one major surface of the diaphragm 20*a* that is opposite to the liquid chambers 16, and a plurality of individual electrodes 24, described later.

The diaphragm 20*a* is provided by a metallic sheet member, for example, a rolled stainless steel sheet having a thickness ranging from 10 μm to 50 μm, or a rolled sheet of any one of the same metals as those used to form the metallic sheet members of the ink accommodating portion 10. In the present embodiment, the diaphragm 20*a* is provided by a rolled stainless steel sheet having a thickness of 30 μm. The diaphragm 20*a* is stacked on, and integrally bonded to, the upper surface of the cavity sheet 14, so that the respective upper openings of all the liquid chambers 16 are closed by the diaphragm 20*a*.

No organic adhesives are used to bond the diaphragm 20*a* and the cavity sheet 14 to each other. In other words, only inorganic substances are present on the bonded surfaces of the diaphragm 20*a* and the cavity sheet 14.

More specifically described, in the case where the ink accommodating portion 10 is constituted by the metallic sheet members, the diaphragm 20*a* is integrated, by solid-phase diffusion bonding, with the portion 10; and in the case where the ink accommodating portion 10 is constituted by the glass sheet members, the diaphragm 20*a* is integrated, by anode bonding, with the portion 10. In the solid-phase bonding or the anode bonding, it is not essentially needed to bond directly the ink accommodating portion 10 and the diaphragm 20*a* to each other. For example, it is possible to use, as an insert, an alloy or a glass that has a melting point lower than the materials used to form the ink accommodating portion 10 and the diaphragm 20*a*, and indirectly bond the two elements 10, 20*a* to each other by melting the insert.

In the present embodiment, the diaphragm 20*a* has a thickness of from 10 μm to 50 μm, and is thinner than conventional diaphragms. Therefore, the diaphragm 20*a* can be operated, i.e., oscillated with a lower electric voltage, i.e., a smaller deformation of the piezoelectric layer 20*b*. Thus, the pressure applying portion 20 can save electric power.

The piezoelectric layer 20*b* is formed on the diaphragm 20*a*, and provides a stress producing member for producing a stress in the diaphragm 20*a* and thereby deforming the same 20*a*. The piezoelectric layer 20*b* is essentially formed of lead zirconate titanate (hereinafter, abbreviated to the "PZT") that is a solid solution of lead titanate and lead zirconate and a ferrodielectric substance. The piezoelectric layer 20*b* has a thickness of about 3 μm to about 20 μm. Since PZT is ferrodielectric, it is polarized in one direction upon application thereto of an electric voltage and, after the application of the electric voltage is stopped, the polarization (i.e., residual dielectric polarization) remains in the PZT. When an electric voltage is applied to the thus polarized PZT, the PZT is deformed. In the present embodiment, the PZT is polarized such that the direction of polarization of the PZT is perpendicular to opposite major surfaces of the diaphragm 20*a*.

A thickness of the piezoelectric layer 20*b* relative to a thickness (or a rigidity) of the diaphragm 20*a* has an optimum range. The greater thickness (i.e., the higher rigidity) the diaphragm 20*a* has, the greater stress is needed to deform the pressure applying portion 20. If the piezoelectric layer 20*b* has a greater thickness, then a greater stress can be produced in the same 20*b*, but a higher electric voltage is needed to drive the layer 20*b*.

Meanwhile, in conventional methods for producing piezoelectric actuators, e.g., a doctor blade method, or a screen printing method, of forming a PZT paste into a PZT green sheet, a piezoelectric layer having a thickness of more than several tens of microns (μm) is formed. That is, the conventional methods are not suitable for forming a piezoelectric layer having a thickness of several microns (μm) to about 10 μm. Thus, the conventional piezoelectric actuators need a high drive voltage. In addition, a chemical vapor deposition method or a sputtering method is known as a method of forming a layer having a thickness of about 1 μm, and is not inapplicable to the present embodiment. However, a piezoelectric layer which can produce a sufficiently great stress is preferably formed by the methods which will be described below by reference to FIGS. 5, 6, and 7.

In the present embodiment, the piezoelectric layer 20*b* is formed by an aerosol-deposition method (hereinafter, abbreviated to the "AD method", see S31 in FIG. 5) or a sol-gel method (see S32).

On an upper surface of the piezoelectric layer 20*b* that is opposite to the diaphragm 20*a*, there are provided a plurality of elongate individual electrodes 24 which are aligned with the liquid chambers 16, respectively, that are located below the piezoelectric layer 20*b* in a direction of stacking of the layer 20*b* on the ink accommodating portion 10. Thus, the individual electrodes 24 are arranged in two arrays in a zigzag fashion in the first direction (i.e., the lengthwise direction) of the portion 10, as shown in an enlarged view indicated at "a" in FIG. 2. Each of the individual electrodes 24 has a strip-like shape, and extends from a widthwise central portion of the piezoelectric layer 20*b*, in the second direction perpendicular to the first direction. In the present embodiment, each of the individual electrodes 24 has a width in its plan view that is somewhat shorter than a width of each of the liquid chambers 16.

The diaphragm 20*a* is formed of an electrically conductive metallic material, and cooperates with the individual electrodes 24 to sandwich respective strip-like portions of the piezoelectric layer 20*b* that correspond to the respective liquid chambers 16. Thus, the diaphragm 20*a* provides a common electrode which is common to all the liquid chambers 16.

A flexible flat cable 40 is connected to an upper surface of the pressure applying portion 20. The flexible flat cable 40 has a plurality of wires, not shown, which are electrically connected to the individual electrodes 24, respectively, independent of each other. Thus, the individual electrodes 24 are electrically connected via the respective wires to a power source and a signal source, both not shown.

When an electric voltage higher than an electric voltage which is usually used to operate the pressure applying portion 20, is applied to all the individual electrodes 24 and the diaphragm 20*a* via the flexible flat cable 40, the respective strip-like portions of the piezoelectric layer 20*b* that are sandwiched by the individual electrodes 24 and the diaphragm 20*a* are polarized. The thus polarized portions of the piezoelectric layer 20*b* provide a plurality of active portions each of which is deformed upon application thereto of the electric voltage to eject a droplet of the ink from a corresponding one of the liquid chambers 16 via a corresponding one of the nozzles 54.

Next, there will be described an ink ejecting operation of the piezoelectric ink jet recording head 6 constructed as descried above, by reference to FIGS. 4A and 4B that are cross-section views taken along 4A (4B)—4A(4B) in FIG. 2.

FIG. 4A shows a state in which no electric voltage is applied to the individual electrodes 24 and the diaphragm 20*a*.

Each of the liquid chambers 16 of the cavity sheet 14 is filled with the ink, and the ink filling the each liquid chamber 16 is delivered to the vicinity of a lower opening of the corresponding nozzle 54 of the nozzle sheet 43, via the corresponding through-holes 17 formed in the spacer sheet 13 and the two manifold sheets 11, 12.

Meanwhile, the ink accommodated by the piezoelectric ink jet recording head 6 (i.e., the ink before ejection from the head 6) is subjected to a negative pressure that acts on the ink in a direction opposite to the direction of ejection thereof from the head 6. Therefore, in the above-indicated state in which no voltage is applied, no ink is ejected from the nozzle 54 opening downward, and accordingly the ink delivered to the nozzle 54 forms a meniscus, Z, shown in FIG. 4A.

Each of the respective active portions of the piezoelectric layer 20*b* that are sandwiched by the respective individual electrodes 24 and the diaphragm 20*a* is aligned with a corresponding one of the liquid chambers 16. In the present embodiment, each active portion is polarized in a direction, indicated at "P", that is perpendicular to the opposite major surfaces of the piezoelectric layer 20*b*, i.e., parallel to the direction of thickness of the layer 20*b*, and the polarization is directed from the upper surface of the layer 20*b* toward the lower surface thereof or the diaphragm 20*a*. The diaphragm 20*a* functioning as the common electrode is grounded.

FIG. 4B shows a state in which the drive voltage is applied to the piezoelectric ink jet recording head 6, such that each of the individual electrodes 24 is a positive electrode and the diaphragm 20*a* is grounded. When the drive voltage is applied to an arbitrary one of the individual electrodes 24 via the flexible flat cable 40, an electric field is produced, in a corresponding one of the active portions, in a direction parallel to the direction P of polarization of the active portion. Consequently the active portion is shrunk in directions, indicated at "X1", "X2" in FIG. 4B, that are perpendicular to the polarization direction P. Since, however, the diaphragm 20*a* is not shrunk, the diaphragm 20*a* and the piezoelectric layer 20*b* are curved convexly toward the liquid chamber 16.

Thus, the liquid chamber 16 is selectively pressurized, and the volume of the chamber 16 is decreased. Consequently the pressure of the ink present in the chamber 16 is increased, and the increased pressure is transmitted to the nozzle 54, so that a droplet of the ink is ejected from the nozzle 54. When the application of the drive voltage is stopped, the curved diaphragm 20*a* and piezoelectric layer 20*b* return to their initial conditions, so that the volume of the chamber 16 returns to its initial value. Since the pressure in the chamber 16 becomes low, some amount of ink is sucked by the chamber 16 from the ink supplying portion (i.e., an appropriate one of the ink cartridge 61). Thus, the recording head 6 returns its initial condition shown in FIG. 4A.

However, it is possible that the drive voltage be usually applied to all the individual electrodes 24 to decrease the respective volumes of the corresponding liquid chambers 16. In this case, when an arbitrary one of the nozzles 54 ejects a droplet of ink delivered from a corresponding one of the liquid chambers 16, the application of the drive voltage to the individual electrode 24 corresponding to the one chamber 16 is stopped, so that the volume of the one chamber 16 is increased because of the elasticity of the pressure applying portion 20 and, thereafter, the drive voltage is applied again to the individual electrode 24, so that the pressure is applied to the ink in the chamber 16 so as to eject a droplet of the ink from the one nozzle 54.

Next, there will be described a method of producing the piezoelectric ink jet recording head 6 constructed as described above.

Figure 5:
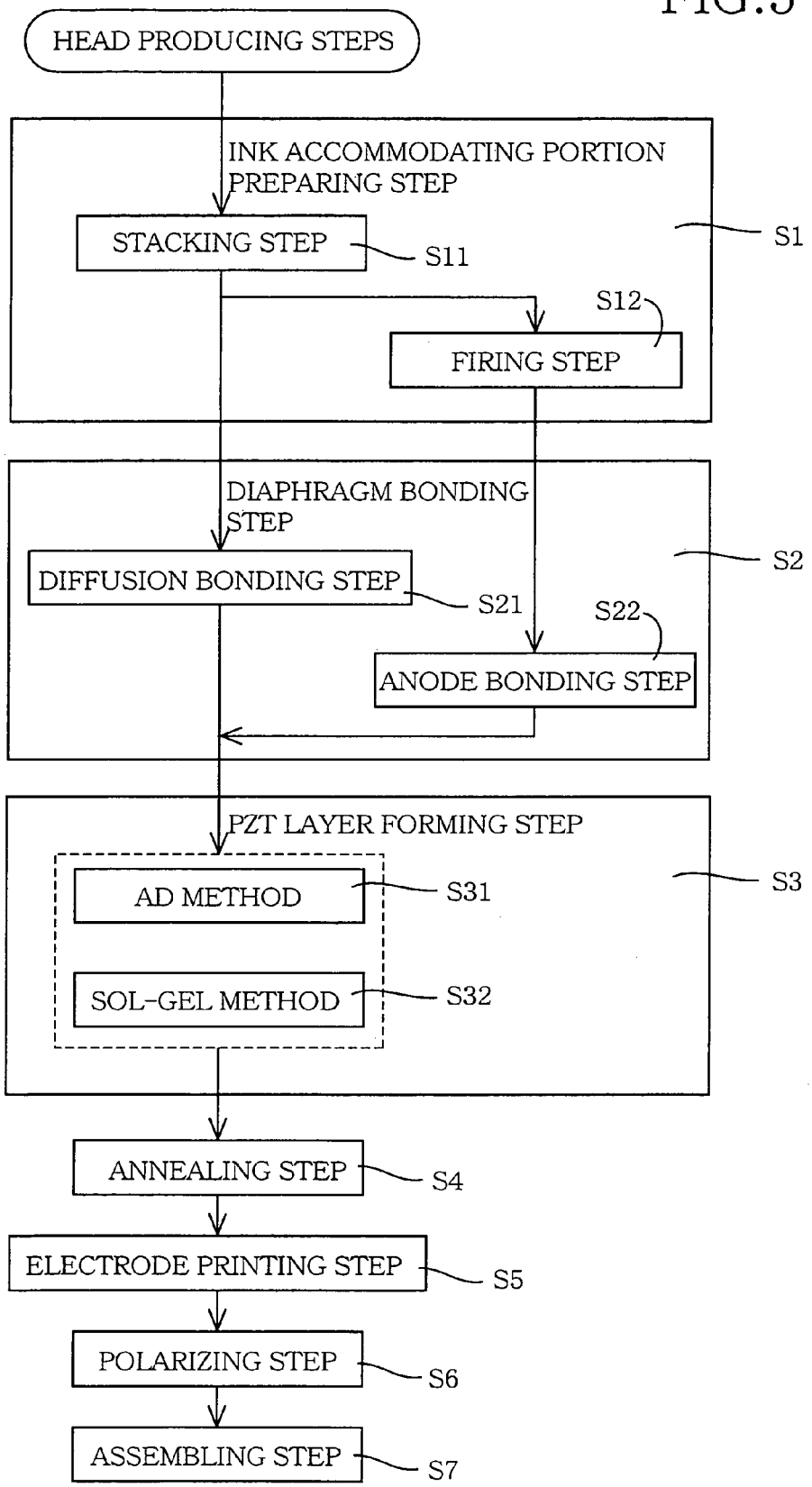
FIG. 5 is a flow chart representing the recording-head producing method according to the present invention.

FIG. 5 shows steps of the method of producing the piezoelectric ink jet recording head 6, i.e., the head producing steps to which the present invention is applied. The head producing steps include an ink accommodating portion preparing step (S1); a diaphragm bonding step (S2); a PZT layer forming step (S3); an annealing step (S4); an electrode printing step (S5); a polarizing step (S6); and an assembling step (S7).

The ink accommodating portion preparing step (S1) is for preparing or producing the ink accommodating portion 10, and includes a stacking step (S11). The stacking step is for stacking a plurality of sheet members to produce the ink accommodating portion 10. The two manifold sheets 11, 12, the spacer sheet 13, and the cavity sheet 14 are positioned relative to each other, and stacked on each other in the order of description, such that the respective through-holes 17 of the manifold sheets 11, 12 and the spacer sheet 13 are aligned with the corresponding inner end portions 16*a* of the liquid chambers 16 of the cavity sheet 14.

In the case where metallic sheet members are stacked to produce the ink accommodating portion 10, the stacked metallic sheet members are temporarily fixed to each other so as to prevent displacements thereof relative to each other and, subsequently, are brought into the diaphragm bonding step (S2). Meanwhile, in the case where glass green sheets are stacked on each other to produce the ink accommodating portion 10, the stacked glass green sheets are, after the stacking step (S11), are brought into a firing step (S12).

The firing step (S12) is for firing the stacked glass green sheets and thereby integrating those sheets with each other. In this step, first, the stacked glass green sheets are subjected to vacuum pressing so as to cause the sheets 11, 12, 13, 14 to contact closely each other. Subsequently, the sheets 11 through 14 are degreased and fired, and thus the ink accommodating portion 10 is prepared. The thus prepared ink accommodating portion 10 is brought into the diaphragm bonding step (S2).

The diaphragm bonding step (S2) is for bonding the diaphragm 20*a* to the ink accommodating portion 10 prepared in the ink accommodating portion preparing step (S1). In this step, the bonding of the diaphragm 20*a* is carried out in either a diffusion bonding step (S21) or an anode bonding step (S22).

The diffusion bonding step (S21) is applied to the stacked metallic sheet members as the ink accommodating portion 10. In this step, the stacked metallic sheet members are heated to their recrystallization temperature (i.e., a temperature of from 1,000° C. to 1,300° C.) or a higher temperature, in vacuum or in an inert atmosphere such as nitrogen or argon, and is compressed for a time of from 0.5 hours to 24 hours at a pressure of from 4.9 MPa to 19.6 MPa.

The anode bonding step (S22) is applied to the glass body as the ink accommodating portion 10. In this step, the glass body prepared in the ink accommodating portion preparing step (S1) is heated up to a temperature lower than a softening point of the glass, and a direct electric voltage of several hundreds of volts is applied to the diaphragm 20*a* as a cathode and the ink accommodating portion 10 as an anode.

In the diffusion bonding step (S21) or the anode bonding step (S22), the diaphragm 20*a* and the ink accommodating portion 10 are bonded to each other. More specifically described, the diaphragm 20*a* and the cavity sheet 14 as part of the ink accommodating portion 10 are bonded to each other. Thus, the cavity sheet 14 corresponds to a first sheet member; and the diaphragm 20*a* corresponds to a second sheet member. However, the cavity sheet 14 may not be a sheet member which is independent of other sheet members, but may be a sheet member which is an integral part of one or more other sheet members.

Thus, no organic adhesives are used in bonding the sheet members of the ink accommodating portion 10 to each other, and bonding the portion 10 and the diaphragm 20*a* to each other. Therefore, the bonded surfaces of the sheet members and the diaphragm 20*a* enjoy improved heat resistance.

The PZT layer forming step (S3) is for forming the piezoelectric layer 20*b* on an upper surface of the diaphragm 20*a*. In this step, the AD (aerosol deposition) method (S31) or the sol-gel method (S32) is used to form a dense piezoelectric layer 20*b* having a thickness of from about 3 μm to about 20 μm. The AD method and the sol-gel method will be described below by reference to FIGS. 6 and 7, respectively.

Figure 6:
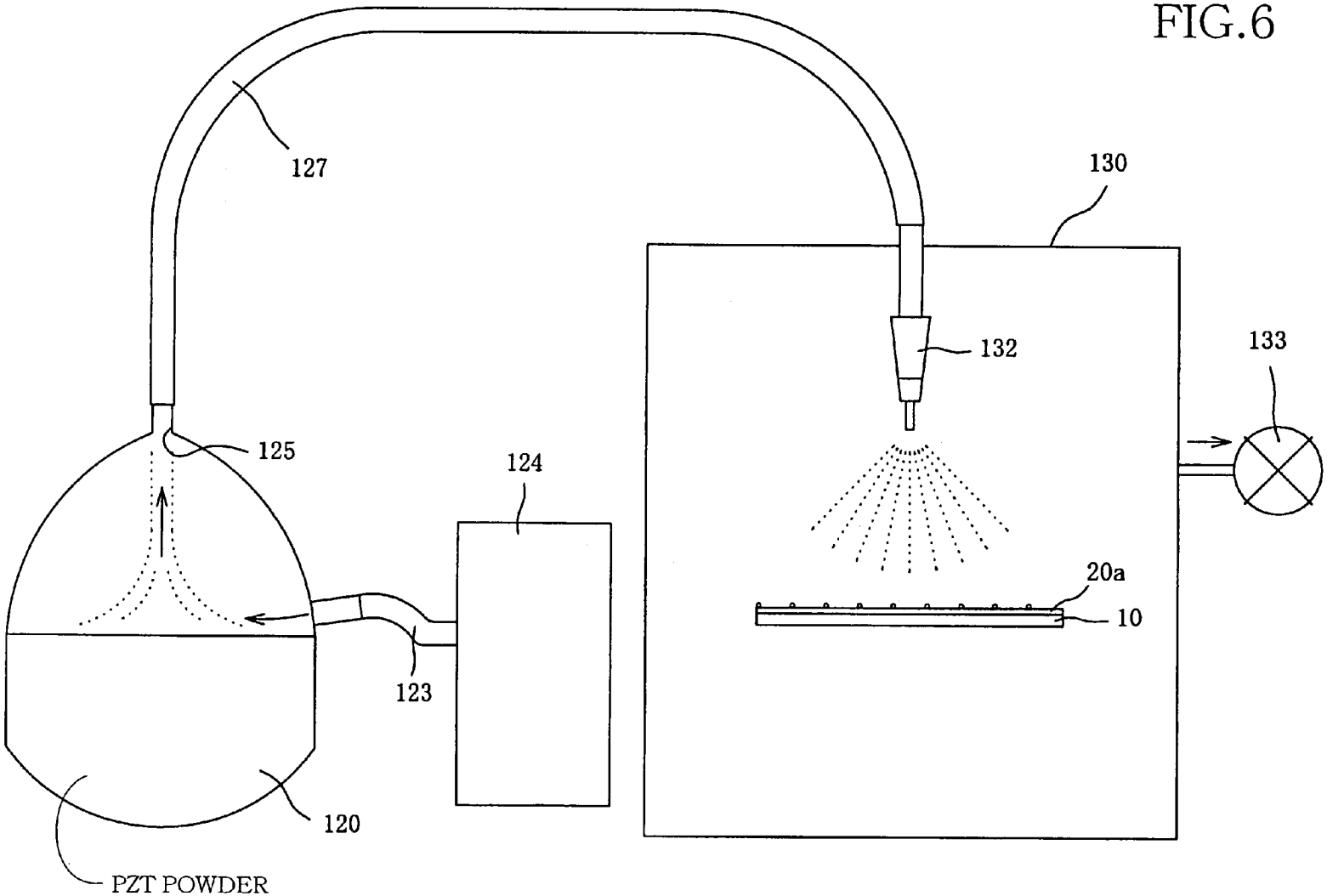
FIG. 6 is a view for explaining an aerosol-deposition method as one of PZT (i.e., lead (Pb) zirconate titanate) layer forming methods.

First, the AD method (S31) as one of the PZT layer forming methods will be described by reference to FIG. 6. In this method, PZT super-fine particles having an average diameter of submicron (smaller than 1 μm) are sprayed, with a gas flow, toward a surface of an object and are bonded with the same. As shown in FIG. 6, the PZT powder are stored in a tank 120, are blown up by a compressed gas as a delivering medium supplied from a gas tank 124 via a tube 123, and are delivered with the compressed gas to a layer forming chamber 130 via an opening 125 and a tube 127. The compressed gas used as the delivering medium is, for example, nitrogen gas or helium gas.

The layer forming chamber 130 is for spraying the PZT powder to the diaphragm 20*a*. The layer forming chamber 130 has, in a ceiling portion thereof, a nozzle member 132 which sprays downward the PZT powder supplied from the tank 120 via the tube 127.

A table, not shown, on which the bonded body obtained by bonding the ink accommodating portion 10 and the diaphragm 20*a* to each other in the diaphragm bonding step (S2) is placed, is provided at a position right below the nozzle member 132. The table is movable along a horizontal X-Y plane that is perpendicular to the direction in which the table is opposed to the nozzle member 132. The bonded body is placed on the table such that the diaphragm 20*a* of the bonded body is opposed to the nozzle member 132.

A vacuum pump 133 is connected to the layer forming chamber 130, so as to remove air from the same 130. When the PZT powder are sprayed, the vacuum pump 133 is operated to reduce a pressure in the layer forming chamber 130 down to a prescribed value.

The PZT powder delivered from the tank 120 are sprayed, at a high speed, from the nozzle member 132 to the diaphragm 20*a* as the object. The kinetic energy of the PZT powder sprayed is converted into thermal energy upon collision of the powder with the diaphragm 20*a*, and the thermal energy causes the powder to be integrated with each other, thereby forming the piezoelectric layer 20*b* on the upper surface of the diaphragm 20*a*. The bonded body placed on the table is moved along the X-Y plane. Thus, the PZT powder are uniformly sprayed onto the upper surface of the diaphragm 20*a*, and accordingly the uniform and dense piezoelectric layer 20*b* is formed. Exposed portions of the ink accommodating portion 10 that are not covered by the diaphragm 20*a* may be masked with an appropriate mask member.

In the AD method (S31), since the PZT powder are sprayed at high speed toward the object, a strong impact is applied to the object. However, in the present method of producing the piezoelectric ink jet recording head 6, the PZT layer forming step (S3) follows the ink accommodating portion preparing step (S1) and the diaphragm bonding step (S2). Therefore, the piezoelectric layer 20*b* can be formed on not the diaphragm 20*a* as a separate member, but the diaphragm 20*a* assembled with the ink accommodating portion 10 and having the higher rigidity. Thus, though the diaphragm 20*a* may be as thin as having the thickness of from 10 μm to 50 μm, the diaphragm 20*a* can stand the strong impact of the PZT powder.

Figure 7:
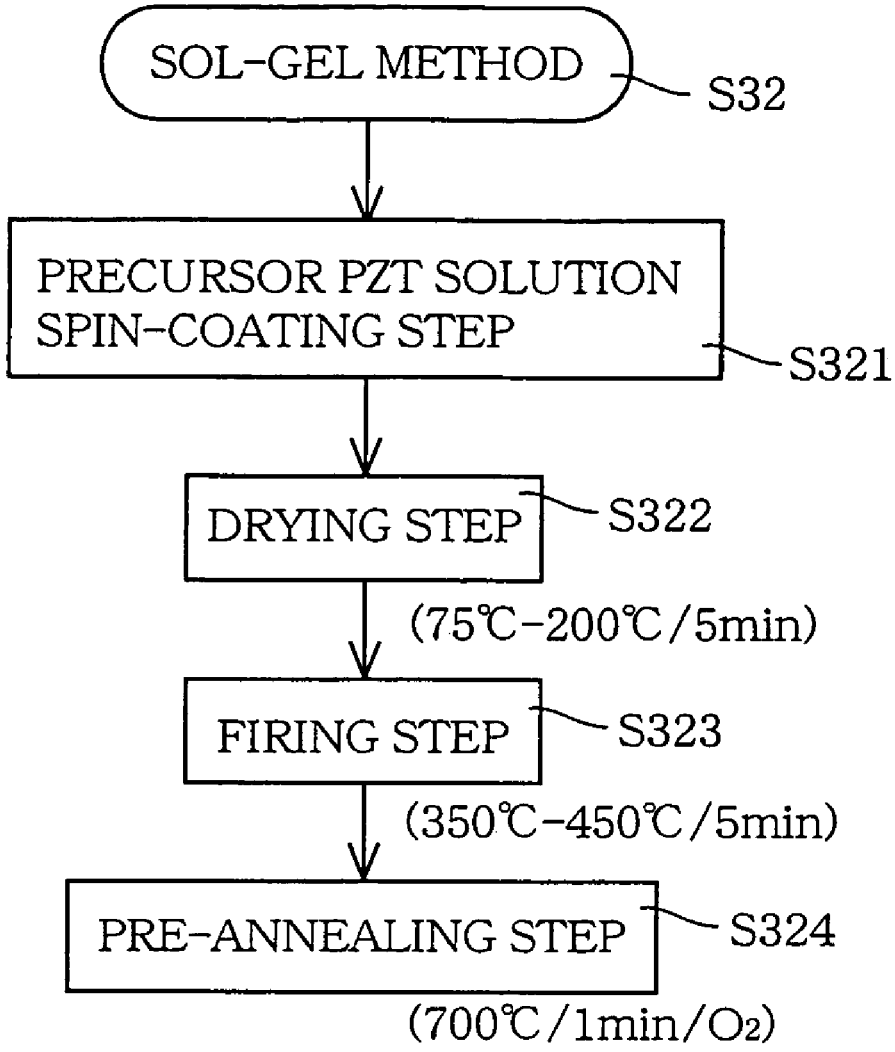
FIG. 7 is a view for explaining a sol-gel method as another PZT layer forming method.

Next, the sol-gel method (S32) as another PZT layer forming method will be described by reference to FIG. 7. In this method, a hydrate complex of a metal hydroxide which can be used to form the piezoelectric layer 20*b*, i.e., a sol is dehydrated to obtain a gel, and the gel is heated to prepare an inorganic oxide.

In the sol-gel method (S32), the piezoelectric layer 20*b* is formed as follows: First, water and alcohol are added to respective alkoxides of titanium, zirconium, lead, and other metallic components, so as to prepare a solution of precursor PZT. This solution is a sol composition.

Then, in a precursor-PZT-solution spin-coating step (S321), the precursor PZT solution is applied, by spin coating, to the diaphragm 20*a*. Since the diaphragm 20*a* has been bonded to the ink accommodating portion 10 in the diaphragm bonding step (S2), the precursor PZT solution is applied to the upper surface of the diaphragm 20*a* bonded to the ink accommodating portion 10. The solution may be applied by a different method than spin coating; for example, dip coating, roll coating, bar coating, screen printing, spraying, or other commonly used coating methods.

The thus applied precursor PZT solution is, in a drying step (S322), dried for five minutes at a temperature of from 75° C. to 200° C., so as to vaporize the solvents. The precursor PZT solution may be applied once more onto the thus dried (or heated) layer, so as to thicken the layer.

After the drying step, the layer is fired in a firing step (S323). In this step, the layer is heated at a temperature high enough, and for a time long enough, to gel the sol composition of the layer and remove the organic matters from the layer. In the present embodiment, the layer is fired at a temperature of from 350° C. to 450° C. and for a time of five minutes. The precursor-PZT-solution spin-coating step (S321), the drying step (S322), and the firing step (S323) are repeated not less than a prescribed number of times, for example, not less than four times, so as to obtain a precursor-piezoelectric layer having a desired thickness. Since the layer is thus dried and degreased, the metal alkoxides in the solution form the network of metal, oxygen, and metal.

Subsequently, in a pre-annealing step (S324), the precursor-piezoelectric layer is subjected to pre-annealing in which the precursor-piezoelectric layer is recrystallized by heating. In this step, the precursor-piezoelectric layer is fired in oxygen atmosphere at 700° C. for one minute. Thus, the precursor-piezoelectric layer is converted into a metal oxide layer having a perovuskite crystal structure, i.e., the piezoelectric layer 20*b*.

In the sol-gel method (S32), heat treatments are repeated. Thus, in the case where the piezoelectric layer 20*b* is formed on the diaphragm 20*a* having the thickness of from 10 μm to 50 μm, it is possible that the layer 20*b* be curled because respective coefficients of thermal expansion of the layer 20*b* and the diaphragm20*a* differ from each other. However, in the present embodiment, the piezoelectric layer 20*b* is formed on not the diaphragm 20*a* separate from other members but on the diaphragm 20*a* assembled with the ink accommodating portion 10 and having the increased degree of rigidity. Therefore, even though the diaphram 20*a* may be as thin as having the thickness of from 10 μm to 50 μm, the piezoelectric layer 20*b* can be prevented from being curled.

If an element being treated is curled, the curled element is hard to handle. In addition, the curling or deforming of the element must be corrected. This leads to lowering the efficiency of production of the recording head 6. In addition, if the degree of curling of the element is too high, the element cannot yield an end product. However, in the present production method, the PZT layer forming step (S3) follows the ink accommodating portion preparing step (S1) and the diaphragm bonding step (S2), and accordingly the curling and deforming of the PZT layer can be effectively prevented. Thus, good products can be produced at a high yield.

Back to FIG. 5, the annealing step (S4) is for growing the crystals of the PZT constituting the piezoelectric layer 20*b* formed in the PZT layer forming step (S3). In this step, the layer 20*b* is subjected to a heat treatment at a high temperature. Annealing conditions are selected depending on the particular method in which the PZT layer is formed. For example, in the case where the PZT layer is formed in the AD method (S31), the layer is heated at a temperature of from 600° C. to 700° C. for one hour. In the case where the PZT layer is formed in the sol-gel method (S32), using an RTA (rapid thermal annealing) furnace, the layer is heated at a temperature of from 600° C. to 1200° C. for a time of from 0.1 minutes to 10 minutes.

In the annealing step (S4), such a high temperature of one thousand and several hundreds of degrees (°C.) at which conventional green sheets are fired is not used, and accordingly the sheet members of the ink accommodating portion 10 are not deformed or damaged. The sheet members of the portion 10 are formed of such materials which can stand the annealing treatment. In this annealing step, the stresses produced in the piezoelectric layer when the layer is formed are released, and the layer is recrystallized to present and improve its proper piezoelectric characteristics. Thus, the piezoelectric layer can be well driven and largely deformed.

Since, in the present embodiment, the piezoelectric layer 20*b* is formed on the diaphragm 20*a* having the high rigidity, the layer 20*b* is not easily separated from, or deformed on, the diaphragm 20*a*, even though the high-temperature heat treatment is carried out in the annealing step (S4).

The electrode printing step (S5) is for forming the individual electrodes 24 on an upper surface of the piezoelectric layer 20*b*. The individual electrodes 24 are printed by first positioning a mask having a pattern corresponding to the pattern of the liquid chambers 16 of the cavity sheet 14, relative to the upper surface of the piezoelectric layer 20*b*, and then applying an electrode paste onto the mask. Thus, the paste is printed at respective locations right above the liquid chambers 16. The thus printed paste is dried under prescribed conditions, and then is fired to produce a metallic layer including the individual electrodes 24.

The polarizing step (S6) is for polarizing the piezoelectric layer 20*b*. In this step, the flexible flat cable 40 is connected to the upper surface of the piezoelectric layer 20*b*, so that the individual electrodes 24 formed in the electrode printing step (S5) are electrically connected to corresponding terminals of the flexible flat cable 40. The individual electrodes 24 are each used as a positive electrode, and the diaphragm 20*a* is used as a negative, common electrode and is grounded. In this state, an electric voltage higher than the voltage used to eject ink is applied to the piezoelectric layer 20*b*. Thus, the piezoelectric layer 20*b* is polarized in a direction perpendicular to the plane of the diaphragm 20*a*, that is, a direction of thickness of the layer 20*b*. This polarization is directed from the upper surface of the layer 20*b* toward the diaphragm 20*a*. Thus, respective portions of the piezoelectric layer 20*b* which are aligned with the individual electrodes 24 are converted into respective active portions each functioning as a piezoelectric body.

Then, in the assembling step (S7), the piezoelectric ink jet recording head 6 is assembled into the ink jet recording apparatus 100.

As is apparent from the foregoing description of the method of producing the piezoelectric ink jet recording head 6, the sheet members 11, 12, 13, 14 of the ink accommodating portion 10 and the diaphragm 20*a* are bonded to each other, without using any organic adhesives, to obtain the recording head 6. Thus, the bonded portions of the recording head 6 can enjoy improved heat resistance. Therefore, though the portion 10 and the diaphragm 20*a* are thermally treated to form the piezoelectric layer 20*b*, the bonded portions of the same 10, 20*a* can maintain their original shape. In addition, since the piezoelectric layer 20*b* is formed on the diaphragm 20*a* bonded to the ink accommodating portion 10, the diaphragm 20*a* can be prevented from being damaged even though the layer 20*b* may be formed under strict conditions. Moreover, the diaphragm 20*a* on which the layer 20*b* has been formed can be handled easily.

While the present invention has been described in its preferred embodiment, it is to be understood that the present invention is not limited to the details of the above-described embodiment but may otherwise be embodied in various manners.

For example, in the above-described production method, the sheet members 11, 12, 13, 14 used are ones which have been worked or machined in advance to have respective shapes designed to obtain a single piezoelectric ink jet recording head 6. However, each of those sheet members 11–14 may be replaced with a sheet member obtained as one of a plurality of sheet members arranged in a matrix. In the latter case, an integral body functioning as a plurality of piezoelectric ink jet recording heads are obtained. This integral body may be subjected to dicing after the polarizing step (S6) and before the assembling step (S7), so as to provide the individual recording heads 6.

In addition, in the above-described embodiment, it is possible to carry out, before the PZT layer forming step (S3), a step of cleaning, and/or applying a primer to, the diaphragm 20*a*, so as to improve the degree of bonding of the piezoelectric layer 20*b* and the diaphragm 20*a*.

In addition, in the above-described embodiment, the diaphragm 20*a* is stacked, by diffusion bonding or anode bonding, on the stacked sheet members 11, 12, 13, 14, except for the nozzle sheet 43, and the piezoelectric layer 20*b* is formed on the upper surface of the diaphragm 20*a* of the thus obtained stacked body. However, in a modified form of the above-described embodiment, the piezoelectric layer 20*b* may be formed on a different sort of stacked body, such as a stacked body consisting of the cavity sheet 14 and the diaphragm 20*a*, or a stacked body consisting of the cavity sheet 14, the spacer sheet 13, and the diaphragm 20*a*.

In the above-indicated modified form, one or more elements, other than the nozzle sheet 43, that does or do not undergo the PZT layer forming step (S3) in which the piezoelectric layer 20*b* is formed may be formed of a material having a low melting point, such as a plastic material. In addition, since one or more organic adhesives can be used, the production cost and/or the production time can be reduced.

On the other hand, the ink accommodating portion 10 may be entirely formed of one or more inorganic materials. That is, the diaphragm 20*a* may be bonded to the ink accommodating portion 10 as a completed product. In the latter case, the producing method can be simplified.

In the above-described embodiment, the diaphragm 20*a* is provided by the metallic sheet member. However, the diaphragm 20*a* may be provided by a silicon substrate.

The above-described embodiment relates to the ink jet recording head 6. However, the present invention may be applied to various sorts of apparatuses each of which delivers a liquid by deforming a piezoelectric element and thereby applying a pressure to the liquid.

In the described AD method, the super-fine particles of the material of the piezoelectric layer 20*b* are sprayed and deposited to form the layer 20*b*. Thus, the diaphragm 20*a* as the second sheet member is subjected to strict conditions. However, since the second sheet member 20*a* can be effectively prevented from being damaged, a thin pressure applying portion 20 including a thin second sheet member 20*a* and a piezoelectric layer 20*b* having an appropriate thickness and formed on the thin second sheet member 20*a* can be obtained.

In the described sol-gel method, the piezoelectric layer 20*b* is formed by applying, by, e.g., spin coating, the solution of the material of the piezoelectric layer 20*b*, heating the applied solution, and repeating the application of the solution and the heating of the applied solution. Thus, the stacked body including the cavity sheet 14 as the first sheet member and the diaphragm 20*a* as the second sheet member is subjected to a heat history in which the stacked body is iteratively heated. Therefore, if the piezoelectric layer 20*b* is formed on, e.g., a thin diaphgram 20*a* which is separate from the cavity sheet 14 or other sheet members 11, 12, 13, the layer 20*b* is likely to be curled or damaged. However, in the present method, the piezoelectric layer 20*b* can be formed on the diaphragm 20*a* which is reinforced by the cavity sheet 14, even though the diaphragm 20*a* may be considerably thin. Thus, the piezoelectric layer 20*b* can be prevented from being curled or damaged. Therefore, a thin piezoelectric element, i.e., a piezoelectric element including the thin diaphragm 20*a* and the piezoelectric layer 20*b* having an appropriate thickness and formed on the thin diaphragm 20*a* can be obtained.

In the described method, the stacked body including the metallic sheet members 11, 12, 13, 14, 20*a* can enjoy a sufficiently high strength and accordingly can stand the formation thereon of the piezoelectric layer 20*b* as the piezoelectric element. In addition, the metallic sheet members 11, 12, 13, 14, 20*a* can be bonded to each other by the bonding method appropriate for the material or materials thereof, and accordingly the stacked body including the integrated sheet members can enjoy a sufficiently high bonding strength.

In the described method, since the cavity sheet 14 as the first sheet member is integrated with one or more other metallic sheet members 11, 12, 13, the sheet members 20*a*, 11 through 14 on which the piezoelectric layer 20*a* is formed have a higher rigidity than a rigidity thereof in a state in which the diaphragm 20*a* as the second sheet member is stacked on the cavity sheet 14 only. Therefore, the diaphragm 20*a* on which the piezoelectric layer 20*b* is formed can enjoy a sufficiently high strength and can stand the formation thereon of the layer 20*b*. Thus, the present method can produce an excellent liquid delivering apparatus. In addition, since the stacked body produced in the stacking step includes the metallic sheet members 11, 12, 13, 14 integrated with each other by the diffusion bonding, the bonding strength of the stacked body is not deteriorated in the annealing step, and the stacked body is not thermally deformed so much as to be defective and unacceptable.

In the described method, since the cavity sheet 14 as the first sheet member is integrated with one or more glass sheet members 11, 12, 13 resulting from firing of one or more glass green sheets, the sheet members 20*a*, 11 through 14 on which the piezoelectric layer 20*b* is formed have a higher rigidity than a rigidity thereof in a state in which the diaphragm 20*a* is stacked on the cavity sheet 14 only. Therefore, the diaphragm 20*a* on which the piezoelectric layer 20*b* is formed can enjoy a sufficiently high strength and can stand the formation thereon of the layer 20*b*. Thus, the present method can produce an excellent liquid delivering apparatus. In addition, the bonding strength of the stacked body produced in the stacking step is not deteriorated in the annealing step, and the stacked body is not thermally deformed so much as to be defective and unacceptable.

It is to be understood that the present invention may be embodied with various changes and improvements that may occur to a person skilled in the art, without departing from the spirit and scope of the invention defined in the appended claims.

What is claimed is:

1. A method of producing at least one liquid delivering apparatus which delivers a liquid from at least one liquid chamber thereof to a location outside the at least one liquid delivering apparatus, by deforming a piezoelectric element thereof provided at a location opposed to the at least one liquid chamber and thereby applying a pressure to the liquid in the at least one liquid chamber, the method comprising the steps of:

stacking a first preformed sheet member having at least one opening defining the at least one liquid chamber and a second preformed sheet member covering the at least one opening, on each other, and integrating, by diffusion bonding or anode bonding, the first and second preformed sheet members with each other so as to provide an integral, stacked body;

forming, of a material of the piezoelectric element, a layer on at least a portion of the second preformed sheet member of the stacked body that is opposed to the at least one opening of the first preformed sheet member of the stacked body; and annealing the layer formed on the stacked body, and thereby crystallizing the material of the layer, so as to change the layer into the piezoelectric element.

2. The method according to claim 1, wherein the forming step comprises forming the layer by spraying super-fine particles of the material and depositing the particles on at least said portion of the second preformed sheet member of the stacked body.

3. The method according to claim 1, wherein the piezoelectric element has a thickness of from about 3 μm to about 20 μm.

4. The method according to claim 1, wherein the forming step comprises forming the layer by applying a solution of the material to at least said portion of the second preformed sheet member of the stacked body, heating the applied solution, and repeating the application of the solution and the heating of the applied solution.

5. The method according to claim 1, wherein the first and second preformed sheet members comprise a first and a second preformed metallic sheet member, respectively, and wherein the stacking step comprises integrating, by diffusion bonding, the first and second preformed metallic sheet members with each other so as to provide the integral, stacked body.

6. The method according to claim 5, further comprising a step of stacking, before the forming step, the first preformed metallic sheet member, and at least one third preformed metallic sheet member having at least one channel hole as part of at least one flow channel communicating with the at least one liquid chamber, on each other, such that the first preformed metallic sheet member provides an outermost layer of the stacked first and third preformed metallic sheet members, and integrating, by diffusion bonding, the stacked first and third preformed metallic sheet members with each other.

7. The method according to claim 5, wherein each of the first and second preformed metallic sheet members is formed of a metal selected from the group consisting of stainless steel, titanium, titanium alloy, copper, copper alloy, tool steel, low alloy steel, nickel, nickel alloy, cobalt alloy, aluminum and aluminum alloy.

8. The method according to claim 5, wherein each of the first and second preformed metallic sheet members is formed of a metal selected from the group consisting of stainless steel, copper, nickel alloy and aluminum alloy.

9. The method according to claim 1, wherein the first preformed sheet member comprises a preformed glass sheet member, and the second preformed sheet member comprises a preformed metallic sheet member or a preformed silicon substrate, and wherein the stacking step comprises integrating, by anode bonding, the preformed glass sheet member, and the preformed metallic sheet member or the preformed silicon substrate, with each other so as to provide the integral, stacked body.

10. The method according to claim 9, further comprising a step of stacking, before the forming step, a first glass green sheet corresponding to the preformed glass sheet member as the first preformed sheet member, and at least one second glass green sheet having at least one channel hole as part of at least one flow channel communicating with the at least one liquid chamber, on each other, such that the first glass green sheet provides an outermost layer of the stacked first and second glass green sheets, and integrating, by firing, the stacked first and second glass green sheets with each other.

11. The method according to claim 1, for producing a plurality of said liquid delivering apparatuses, wherein the method further comprises dividing an intermediate product which gives the plurality of liquid delivering apparatuses and which is obtained after the stacking step, the forming step, and the annealing step, thereby providing the plurality of liquid delivering apparatuses.

12. A liquid delivering apparatus, comprising:

a first preformed sheet member which has at least one liquid chamber accommodating a liquid;

a second preformed sheet member which is stacked on the first preformed sheet member to cover the at least one liquid chamber thereof, wherein the first and second preformed sheet members are integrated with each other by diffusion bonding or anode bonding; and a piezoelectric element which is provided, by crystallization by annealing of a material thereof, on at least a portion of the second preformed sheet member that is opposed to the at least one liquid chamber of the first preformed sheet member, which has a thickness of from about 3 μm to about 20 μm, and which is deformed to apply a pressure to the liquid in the at least one liquid chamber and thereby deliver the liquid from the at least one liquid chamber to a location outside the liquid delivering apparatus.

13. The liquid delivering apparatus according to claim 12, further comprising at least one individual electrode which is opposed to the at least one liquid chamber via the piezoelectric element and the second preformed sheet member, wherein the second preformed sheet member comprises a preformed common electrode, and wherein the at least one individual electrode and the preformed common electrode cooperate with each other to sandwich at least one portion of the piezoelectric element that is polarized to provide at least one active portion which is deformed relative to the at least one liquid chamber so as to apply the pressure to the liquid in the at least one liquid chamber.

14. The liquid delivering apparatus according to claim 12, wherein the first and second preformed sheet members comprise a first and a second preformed metallic sheet member, respectively, which are integrated, by diffusion bonding, with each other.

15. The liquid delivering apparatus according to claim 14, further comprising at least one third preformed metallic sheet member which has at least one channel hole as part of at least one flow channel communicating with the at least one liquid chamber, and which is stacked on the first preformed metallic sheet member and is integrated, by diffusion bonding, with the first preformed metallic sheet member.

16. The liquid delivering apparatus according to claim 14, wherein each of the first and second preformed metallic sheet members is formed of a metal selected from the group consisting of stainless steel, titanium, titanium alloy, copper, copper alloy, tool steel, low alloy steel, nickel, nickel alloy, cobalt alloy, aluminum and aluminum alloy.

17. The liquid delivery apparatus according to claim 14, wherein each of the first and second preformed metallic sheet members is formed of a metal selected from the group consisting of stainless steel, copper, nickel alloy and aluminum alloy.

18. The liquid delivering apparatus according to claim 12, wherein the first preformed sheet member comprises a first preformed glass sheet member, and the second preformed sheet member comprises a preformed metallic sheet member or a preformed silicon substrate, and wherein the first preformed glass sheet member, and the preformed metallic sheet member or the preformed silicon substrate are integrated, by anode bonding, with each other.

19. The liquid delivering apparatus according to claim 18, further comprising at least one second glass sheet member which has at least one channel hole as part of at least one flow channel communicating with the at least one liquid chamber, and which is integrated, by firing, with the first glass sheet member.

20. The liquid delivering apparatus according to claim 12, wherein the first preformed sheet member has a thickness of from about 50 μm to about 150 μm.

21. The liquid delivering apparatus according to claim 12, wherein the second preformed sheet member has a thickness of from about 10 μm to about 50 μm.

22. The liquid delivering apparatus according to claim 12, wherein the liquid accommodated by the at least one liquid chamber comprises an ink, and wherein the liquid delivering apparatus comprises an ink jet recording head having at least one ink ejection nozzle which communicates with the at least one liquid chamber and which ejects a droplet of the ink to a location outside the ink jet recording head.

23. A method of producing a liquid delivering apparatus which delivers a liquid from at least one liquid chamber thereof to a location outside the liquid delivering apparatus, by deforming a piezoelectric element thereof provided at a location opposed to the at least one liquid chamber and thereby applying a pressure to the liquid in the at least one liquid chamber, the method comprising the steps of:

stacking a first preformed sheet member having at least one opening defining the at least one liquid chamber and a second preformed sheet member covering the at least one opening, on each other, and integrating, by diffusion bonding or anode bonding, the first and second preformed sheet members with each other so as to provide an integral, stacked body;

forming, of a material of the piezoelectric element, a layer by spraying super-fine particles of the material and depositing the particles on at least a portion of the second preformed sheet member of the stacked body that is opposed to the at least one opening of the first preformed sheet member of the stacked body; and annealing the layer formed on the stacked body so as to change the layer into the piezoelectric element.

24. A method of producing a liquid delivering apparatus which delivers a liquid from at least one liquid chamber thereof to a location outside the liquid delivering apparatus, by deforming a piezoelectric element thereof provided at a location opposed to the at least one liquid chamber and thereby applying a pressure to the liquid in the at least one liquid chamber, the method comprising the steps of:

stacking a first preformed sheet member having at least one opening defining the at least one liquid chamber, and a second preformed sheet member covering the at least one opening, on each other, and integrating, by diffusion bonding or anode bonding, the first and second performed sheet members with each other so as to provide an integral, stacked body;

forming, of a material of the piezoelectric element, a layer by applying a solution of the material to at least a portion of the second preformed sheet member of the stacked body that is opposed to the at least one opening of the first preformed sheet member of the stacked body, heating the applied solution, and repeating the application of the solution and the heating of the applied solution; and annealing the layer formed on the stacked body so as to change the layer into the piezoelectric element.

* * * * *